United States Patent [19]

Dellacroce

[11] Patent Number: 5,025,979

[45] Date of Patent: Jun. 25, 1991

[54] HANGING EXPANDABLE FILE

[75] Inventor: Cheryl Dellacroce, Baldwin, N.Y.

[73] Assignee: Esselte Pendaflex Corporation, Garden City, N.Y.

[21] Appl. No.: 394,357

[22] Filed: Aug. 15, 1989

[51] Int. Cl.[5] ..... B65D 5/00

[52] U.S. Cl. ..... 229/1.5 R; 312/184

[58] Field of Search ..... 229/1.5 R, 72; 312/184

[56] References Cited

U.S. PATENT DOCUMENTS

| | | | |
|---|---|---|---|
| 574,974 | 1/1897 | Wiley | 229/72 |
| 821,019 | 5/1906 | Cooke, Jr. | 229/72 |
| 1,634,450 | 7/1927 | Bushnell | 229/1.5 R |
| 1,698,841 | 1/1929 | Doughty | 229/72 |
| 1,745,249 | 1/1930 | Doughty | 229/1.5 R |
| 4,400,107 | 8/1983 | Pitts | 312/184 |

*Primary Examiner*—Stephen P. Garbe

*Attorney, Agent, or Firm*—Darby & Darby

[57] ABSTRACT

A decorative expandable hanging file has closed reinforced sides, a supportive base and reinforced partitions. The partitions may contain vertically extending label surfaces to allow for file identification while the file is stored in a standard hanging file frame.

7 Claims, 1 Drawing Sheet

HANGING EXPANDABLE FILE

TECHNICAL FIELD

The present invention relates to paper office supplies and in particular, to paper expandable files having alphabetized internal sections and attachments for hanging the file onto a standard filing frame in office storage equipment.

BACKGROUND ART

Expandable files are a necessary tool in the modern office or business and are also used in homes and schools. These files are typically rectangular in cross section with z-shaped folds along the sides which allow the file to expand from front to back. The files are shipped and stored in their compact state. When put into use they expand gradually as they are filled with papers or other items. Generally, expandable files are stored on shelves with their front and rear faces perpendicular to the length of the shelf.

Shelved expandable files are normally labelled with a marker on the front, so the contents can be known when the file is lying flat on a table or desk, and on the side, so the file can be identified when shelved. The problem with side labelling is that the z-folded side portion must be unfolded or flattened to write on it, making labelling difficult, and once labelled, the z-folds reshape, making the labelled side difficult or impossible to read without reflattening the side of the folder. In tightly packed shelves, reflattening to read a side label may necessitate removing multiple files from the shelf in order to locate the desired file. This procedure is both bothersome and time consuming.

In contrast to shelved expandable files, hanging folder files are typically stored in a unit such as file drawers or cabinets having a standardized legal size (8½" by 14") or letter size (8½" by 11") filing frame on which horizontally protruding attachments on the hanging files are secured. Labelling tabs which protrude vertically above the top of the file can be added to identify the file without need for removal from the filing unit. Hanging folder files are typically one folded piece of paper without closed sides, making "expansion" possible, but leading to loss of papers or other stored items through the open side portions, especially when the file is removed from its storage unit. Hanging folder files are also flimsy and therefore cannot stand up on a desk or table as can an expandable file.

Thus, there is a need for a file which combines the advantages of an expandable file, namely expansion capability, durability, closed sides and supportive base, with the advantages of a hanging file, namely standard size and attachments for storage in a filing unit and suitability for the addition of top-labelling which can be viewed from the drawer without the need for removing the file.

SUMMARY OF THE PRESENT INVENTION

The present invention is directed to an expandable hanging file which provides multiple advantages for the user. First, the file has a supportive expandable base which allows it to stand. Second, it has closed expandable sides allowing the file to be stored compacted and gradually filled without the danger of loss of stored items through open sides, as with conventional hanging files. Third, the file is suitable for storage in a standard filing unit due to its standard spaced hanging attachments. Fourth, the file has built in reinforcing partitions with tabs for labelling, which tabs protrude vertically above its top, making file identification possible without the need to remove the file from its storage unit.

In contrast to labelling tabs currently in use, the labelled partitions glued to the file sections of the present invention add both bulk and strength to the file, prolonging its usefulness. The files also have additional reinforcement strips along the top of each expandable side or gusset, in the area commonly handled by users. These strips prolong the life of the file, saving cost and time by increasing the time interval between the need for replacement of the file with a new file when the old one wears out.

The file's labelling partitions can be provided with pressure-sensitive blank labels for multiple uses or with preprinted labels, for instance with the alphabet, to facilitate alphabetized filing. The file can hang alongside conventional hanging files for multiple uses, i.e., as a "to be sorted file", a "tickler" reminder file, or a "hot" file for very current papers.

In an illustrative embodiment of the invention a hanging expandable file has a body portion with front and rear faces, an open top which allows access to labelled tabbed sections and expandable z-folded bottom and side portions for increased storage capacity. Connection of each edge of the expandable portion to a complementary location on the front or rear face of the file is accomplished by gluing of the terminal z-fold of each edge of the expandable portion to a respective location on the front or rear face. Standardized hanging means are provided in the form of two metal rods with indented end portions. These rods are disposed through folds in the top portions in the front and rear faces of the file and allow for storage by hanging the file by means of the rods on standard 8½" by 11" or 8½" by 14" file frames in a standard storage unit.

In a preferred embodiment, the top of each lateral side of the file has a reinforcing strip, and each partition has a reinforcing flange which bends into the adjacent z-fold, thus strengthening the sides of the file and prolonging its life and usefulness.

BRIEF DESCRIPTION OF THE DRAWINGS

The foregoing and other features of the present invention will be more readily apparent from the following detailed description and drawings of an illustrative embodiment of the invention in which.

DESCRIPTION OF THE PREFERRED EMBODIMENTS

Figure 1:
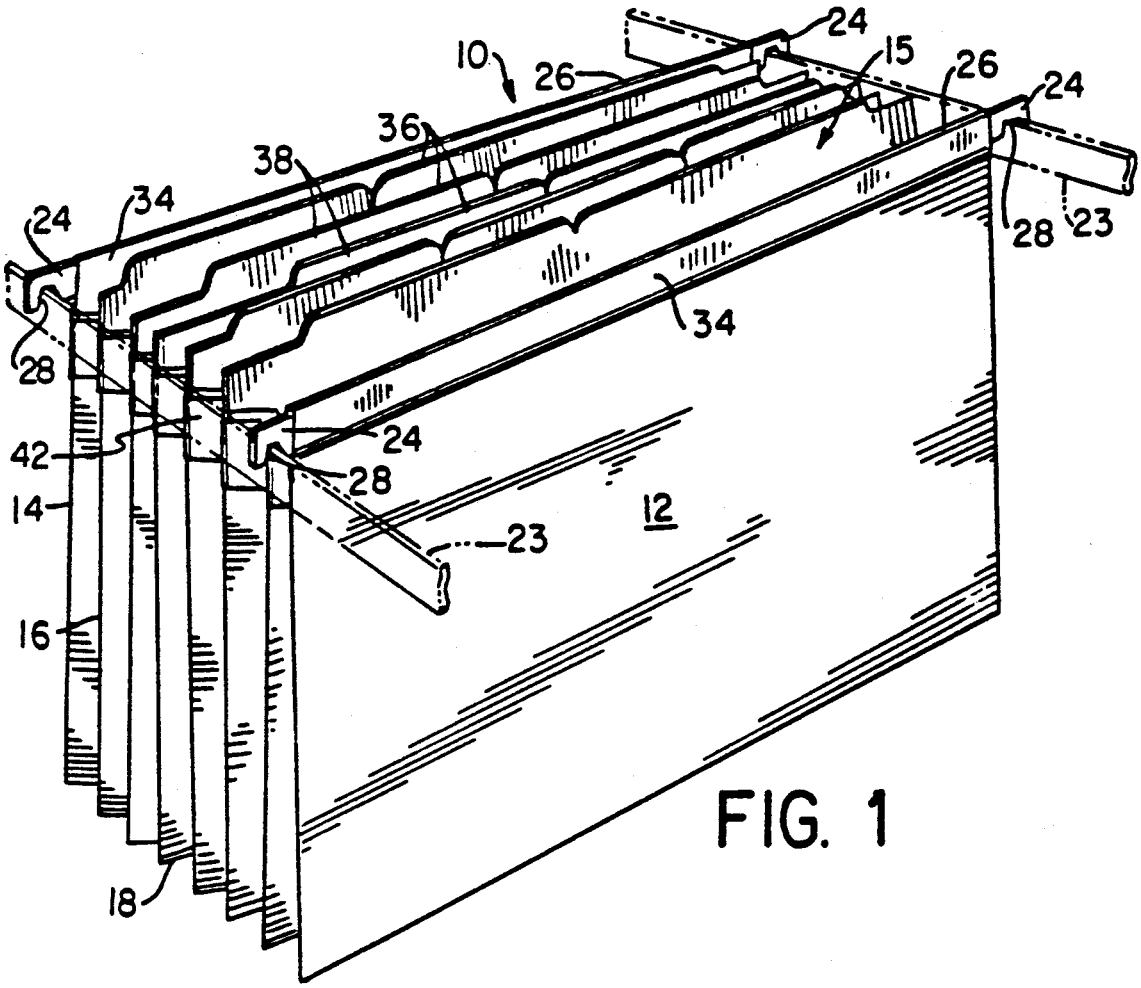
FIG. 1 shows a perspective view of a hanging expandable file according to the present invention.
Figure 2:
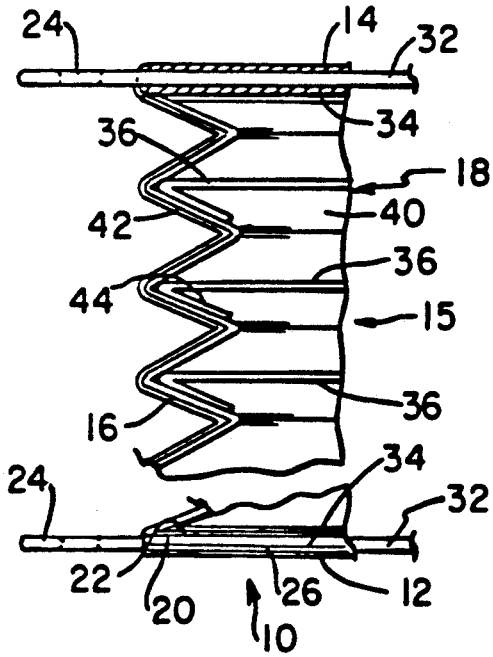
FIG. 2 shows a top plan view, partially in section and partially broken, of the left lateral expandable side portion of a hanging file according to the present invention.

As shown in FIG. 1, a hanging expandable file 10 has a front face 12, a rear face 14, an open top 15 and a connection between the front and rear faces in the form of z-folded expandable sides 16 and bottom 18, which, as shown in FIG. 2, are immovably fixed to the respective complementary edges of the front face 12 or rear face 14 by gluing, stapling or otherwise attaching the terminal z-fold 20 to the edge 22 of the faces 12 and 14.

As shown in FIG. 1, the expandable file 10 hangs on standard parallel rods 23 of a filing frame in a standard filing unit by means of horizontally extending protrusions 24 extending from each of the four top edges 26 of the front and rear faces 12 and 14. Each protrusion 24 has a bottom notch 28 which rests on the top of a parallel rod 23 in a standard filing unit. As shown in FIGS. 1 and 2, in preferred embodiments, the protrusions 24 are the lateral ends of two metal rods 32 which are inserted through folds 34, in the top of the front and rear faces, 12 and 14.

Preferred embodiments also include a series of partitions 36 with top tabs 38 for sorting and/or labelling purposes. This sorting may take the form, for example, of alphabetizing a series of documents where each tab is labelled with several consecutive letters of the alphabet, so that each letter of the alphabet belongs to a designated section 40 as shown in FIG. 2, which section comprises the space between two parallel lateral z-folds, i.e. between partitions.

Some embodiments, as shown in FIGS. 1 and 2, further include reinforcing strips 42 on the top of each expandable lateral side 16. The tabbed partitions 36 have a reinforcing flange 44 in the form of a horizontal length extension which is folded and glued to the expandable side 16 for added strength.

While the present invention has been particularly shown and described with reference to preferred embodiments thereof, it should be clear that various alternatives and modifications are included within the spirit and scope of the invention which is limited only by the appended claims.

I claim:

1. A hanging expandable file comprising:

a body portion having front and rear faces;

an open top;

connection means for expandably securing the bottom and side edges of said front and rear faces said connection means including lateral sides and a bottom, the ends of the lateral sides and bottom being fixed to the side and bottom edges, respectively, of said front and rear faces, the top of each lateral side having a reinforcing strip;

means for sorting items to be stored in the file, said means for sorting including a series of partitions, each partition having an integral reinforcing flange at its sides which are attached to the lateral sides of said body portion; and hanging means for storing the file in a standard file container.

2. A file as claimed in claim 1 wherein said lateral sides and bottom of the file have multiple z-folds.

3. A file as claimed in claim 2 wherein said partitions create sections between them, the partitions being arrange such that each section comprises the space between two parallel lateral z-folds.

4. A file as claimed in claim 2 wherein said hanging means is a multiplicity of horizontally extending protrusions, at least one protrusion extending laterally from the top edge of said front and rear faces, each protrusion having a notch complementary to parallel rods in a standard filing frame.

5. A file as claimed in claim 4 wherein the top of each of the front and rear faces of said file have a fold, and said horizontally extending protrusions the lateral ends of two metal rods, each rod being slidably disposed through a fold.

6. A file as claimed in claim 5 wherein the fixation of the ends of said expandable portion to said front and rear faces is accomplished by gluing the terminal z-folds each edge of said expandable portion to a respective edge of said front or rear face.

7. A file as claimed in claim 5 wherein said body portion is made of heavy paper.

* * * * *